US005299551A

United States Patent [19]

Tofel et al.

[11] Patent Number: 5,299,551

[45] Date of Patent: Apr. 5, 1994

[54] CARBURETOR KIT FOR IMPROVED AIR-FUEL MIXTURE

[76] Inventors: Richard M. Tofel, 6221 North Cadena de Montanas, Tucson, Ariz. 85718; Jon A. Petty, 2767-B W. Anklam, Tucson, Ariz. 85745

[21] Appl. No.: 16,047

[22] Filed: Feb. 10, 1993

[51] Int. Cl.[5] ..... F02D 41/14

[52] U.S. Cl. ..... 123/701

[58] Field of Search ..... 123/437, 438, 701; 60/276

[56] References Cited

U.S. PATENT DOCUMENTS

| | | | |
|---|---|---|---|
| 3,730,157 | 5/1973 | Gerhold | 123/437 |
| 3,742,924 | 7/1973 | Bachle | 123/676 |
| 3,921,612 | 11/1975 | Aono | 123/438 |
| 4,034,727 | 7/1977 | Aono et al. | 123/701 |
| 4,034,730 | 7/1977 | Ayers et al. | 123/701 |
| 4,191,149 | 3/1980 | Dutta et al. | 123/701 |
| 4,363,209 | 12/1982 | Atago et al. | 60/274 |
| 4,512,304 | 4/1985 | Snyder | 123/344 |

*Primary Examiner*—Tony M. Argenbright

*Attorney, Agent, or Firm*—Antonio R. Durando; Harry M. Weiss

[57] ABSTRACT

Flow passage lines are used to connect the float chamber of a conventional carburetor both to the engine's intake manifold and to a tube positioned downstream of the radiator fan. The air flow produced by the fan provides a continuous source of positive pressure to the float chamber, while the engine's suction and the corresponding vacuum in the intake manifold provide a continuous source of negative pressure. The positive pressure line is constantly open to the float chamber and is also connected to the negative pressure line by means of a control solenoid valve. When the valve is closed, the pressure in the float chamber reflects the full impact of the positive pressure differential generated by the radiator fan. As the valve is progressively opened, the vacuum of the intake manifold gradually reduces the positive pressure differential transmitted to the chamber; at some point, the effect of the vacuum source overcomes the effect of the positive pressure source and a net negative pressure differential is provided to the float chamber. The solenoid valve is responsive to a control signal generated by an electronic circuit as a function of deviations in the oxygen content of the exhaust gases from a desired set point. Accordingly, the ambient pressure in the float chamber is either increased or decreased as the oxygen sensor indicates that either a lean or a rich fuel mixture is being combusted in the engine.

14 Claims, 4 Drawing Sheets

CARBURETOR KIT FOR IMPROVED AIR-FUEL MIXTURE

BACKGROUND OF THE INVENTION

1. Field of the Invention

This invention is related in general to carburetors for internal-combustion engines that comprise a feedback control system responsive to the composition of the engine exhaust gases. In particular, this invention provides a new device for improving the air-fuel mixture supplied to the engine by controlling the pressure in the float chamber of the carburetor.

2. Description of the Related Art

As is well understood in the art, conventional internal-combustion engines are fueled with an air-fuel mixture that is formed in the carburetor and passed to the intake manifold of the engine. Referring to the schematic representation of FIG. 1, ambient air is drawn by the engine suction into the intake manifold 2 through a venturi tube 4 contained within the body of the carburetor 6. The flow of air is controlled by the position of a throttle 8, which normally consists of a butterfly valve operated by a user by means of a remote linkage system. When the valve is closed and the engine is idling, little air passes through the venturi tube, so that little or no fuel is drawn into the air stream by the venturi effect in tube 4; the fuel is instead drawn by the engine's suction directly from the float chamber or bowl 10 into the manifold 2 through an idle bypass circuit 12. As the throttle valve is opened and more air is allowed to pass through the venturi tube, the decrease in static pressure created by the restriction in the tube causes a pressure differential that results in fuel being delivered to the air stream within the venturi tube itself through a main jet system 14. As the throttle is further opened and the engine's speed (rpm) increases, more air is drawn causing a yet lower static pressure within the venturi tube and greater fuel flow rate into the air stream.

In order to optimize fuel efficiency and pollution control, the air-fuel ratio in the mixture flowing to the engine should at all times be equal to the stoichiometric ratio required for full combustion. This is impossible to achieve with a system that relies on a number of fixed-size jets to meter the fuel flow to the intake manifold. Therefore, in designing a carburetor, the dimensions of the jets in the idle bypass circuit 12 and in the main jet system 14 are chosen to provide air-fuel ratios corresponding to optimal overall performance within the range of operation of the engine. Typically, the mixture is richer than the stoichiometric requirement (that is, it contains more fuel than necessary for complete combustion) at idle speeds and it becomes progressively leaner at higher speeds. The resulting effect is that the air-fuel ratio is sub-optimal nearly at all times. Thus, additional methods of controlling the air-fuel ratio are required for optimal performance.

From the foregoing and from basic principles of fluid dynamics it becomes apparent that the pressure in the float chamber of a conventional internal-combustion engine carburetor affects the air-fuel mixture delivered to the engine. In conventional carburetors, the float chamber is kept at substantially atmospheric pressure by means of a vent typically connecting the chamber to a region downstream of the air filter. As a result, the air-fuel ratio is determined only by the pressure in the venturi tube (or manifold, at idle speed) and by the metering of the various jets in the carburetor as fuel is drawn from the float chamber by the suction created in the main venturi tube. By varying the pressure in the float chamber, an additional control variable is available that can be used to regulate the air-fuel ratio to the engine. Several patents have described devices that utilize this principle in a feedback control loop system for optimizing the composition of the air-fuel mixture at all times during operation. Typically, these systems measure the oxygen content in the engine's exhaust and utilize it as a measure of the deviation of the air-fuel ratio from the optimal mixture. This information is then used to generate a control signal for varying the pressure in the float chamber. If the exhaust's oxygen content indicates that the mixture is too rich, the pressure is decreased, resulting in a reduced flow rate of fuel to the venturi tube and, accordingly, a leaner mixture. The opposite control action is produced, of course, when the mixture is too lean.

For example, U.S. Pat. No. 3,742,924 issued to Bachle (1973) describes a device for providing variable ambient pressure in the float chamber of a carburetor. The pressure variations are produced by a valve installed in a tube connecting the chamber to the venturi of the carburetor, so that a vacuum (and a leaner mixture) is obtained when the valve is open. The control of the valve is effected by a solenoid driven by the signal generated by a sensor in the exhaust pipe of the engine.

In U.S. Pat. No. 4,034,727 (1977), Aono et al. describe a similar device where the pressure variation in the float chamber is produced by a vibrating diaphragm built into the vapor side of the chamber. The diaphragm is driven by an electromagnetic transducer, which is itself controlled by a signal designed to optimize the fuel mixture under varying operating conditions.

U.S. Pat. No. 4,0347,730 to Ayres et al. (1977) discloses a carburetor where the pressure of the fuel in the float chamber is determined by the operation of an electric fuel pump. The pump in turn is controlled by electronic circuitry responsive to a sensor in the exhaust pipe of the system. When the fuel mixture is too lean with respect to a set point for the driving conditions, the pump produces a higher pressure and more fuel is supplied to the venturi. The converse occurs, on the other hand, when the mixture is too rich.

U.S. Pat. No. 4,191,149 to Dutta et al. (1980) shows a carburetor where the pressure in the float chamber is varied by means of a line connected to the restriction of a venturi tube. The tube is coupled to a compressor on one side and to a valve open to the atmosphere on the other, so that the pressure drop across the venturi is affected by the opening of the valve. As the valve is closed, the pressure in the venturi increases, also causing the pressure in the float chamber to increase and produce a richer mixture. A system of orifices in every segment of the system is used to optimize the effect of the valve on the float chamber pressure. In another embodiment of the invention, air is drawn by the vacuum in the exhaust manifold from the outside atmosphere into a venturi tube connected to the float chamber. The air flow is regulated by a valve actuated by a controller responsive to the signal generated by an oxygen sensor in the exhaust stream. When the valve is closed, a vacuum is transmitted to the float chamber; as the valve opens, air is drawn from the outside through the Pitot tube and the pressure in the float chamber increases accordingly.

In U.S. Pat. No. 4,512,304 (1985), Snyder describes a device for regulating the supply of fuel to the engine. Pressure is applied to the regulator to cause a predetermined rate of flow of gasoline to the carburetor, thereby affecting the air to fuel ratio. The pressure exerted is a result of a signal from an exhaust gas sensor.

Finally, U.S. Pat. No. 4,363,209 to Atago et al. (1982) discloses a carburetor system that produces a negative pressure on the fuel jets in order to vary the throughput to the venturi. The negative pressure is obtained by connecting a vacuum source to the jet ducts by means of a valve responsive to a control circuit connected to an exhaust gas sensor.

All of these systems require either modifications to the design of a conventional carburetor or additions of expensive apparatus to standard equipment. Therefore, they are not economically suitable for after-market application. In addition, physical constraints often limit the ability of some devices to perform according to their design specifications. For example, we found that the second embodiment of the invention described in the Dutta et al. patent is not practically feasible for correcting a lean mixture because a very large air intake would be required to generate a positive pressure to the float chamber through a Pitot tube. This air would then flow to the intake manifold and further dilute an already lean mixture, thus aggravating the condition and providing no effective control.

Therefore, there still exists a need for simpler and more effective system for optimizing an engine's air-fuel ratio by varying the pressure in the float chamber of the carburetor. The present invention is directed at apparatus that permits the easy and relatively inexpensive conversion of a conventional carburetor to a feedback-controlled system that effectively varies the air-fuel ratio for optimal operation under all conditions.

BRIEF SUMMARY OF THE INVENTION

It is therefore an object of this invention to provide apparatus in the form of a kit that can be installed on a conventional carburetor system as an after-market product.

It is another object of the invention to provide apparatus that controls the flow of fuel from the float chamber to the air stream of a conventional carburetor by varying the ambient pressure in the float chamber in response to variations in the oxygen content in the exhaust gases from a predetermined set point.

It is yet another goal of the invention to provide both positive and negative pressure controls by utilizing sources available within the standard equipment of an engine, so that the use of an additional compressor or vacuum pump becomes unnecessary.

Still another objective is apparatus that can be calibrated to function effectively on any engine fueled by a conventional carburetor, regardless of size and specific carburetor design.

A final objective of this invention is the realization of the above mentioned goals in an economical and commercially viable manner.

These goals are achieved according to this invention by connecting the float chamber of a conventional carburetor both to the engine's intake manifold and to a tube positioned downstream of the radiator fan. The air flow produced by the fan provides a continuous source of positive pressure to the float chamber, while the engine's suction and the corresponding vacuum in the intake manifold provide a continuous source of negative pressure. The positive pressure line is constantly open to the float chamber and is also connected to the negative pressure line by means of a control solenoid valve actuated by pulse signals. When the valve is closed, the pressure in the float chamber reflects the full impact of the positive pressure differential generated by the radiator fan. As the valve is progressively pulsed opened, the vacuum of the intake manifold gradually reduces the positive pressure differential transmitted to the chamber; at some point, the effect of the vacuum source overcomes the effect of the positive pressure source and a net negative pressure differential is provided to the float chamber. The solenoid valve is responsive to a control signal generated by an electronic circuit as a function of deviations in the oxygen content of the exhaust gases from a desired set point. Accordingly, the ambient pressure in the float chamber is either increased or decreased as the oxygen sensor indicates that either a lean or a rich fuel mixture is being combusted in the engine.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose only some of the various ways in which the invention may be practiced.

DETAILED DESCRIPTION OF THE PREFERRED EMBODIMENT

As illustrated in the devices noted in the prior art, the idea of regulating the air-fuel mixture in a carburetor by controlling the ambient pressure in the float chamber is not new and is well understood. This invention is based on a novel way to provide both the negative and the positive pressure differentials required to implement the concept without installing pressure sources in addition to the equipment found in standard internal-combustion engines. Moreover, the apparatus of the invention can be installed on any engine with only minor modifications to the carburetor and exhaust system.

Figure 1:
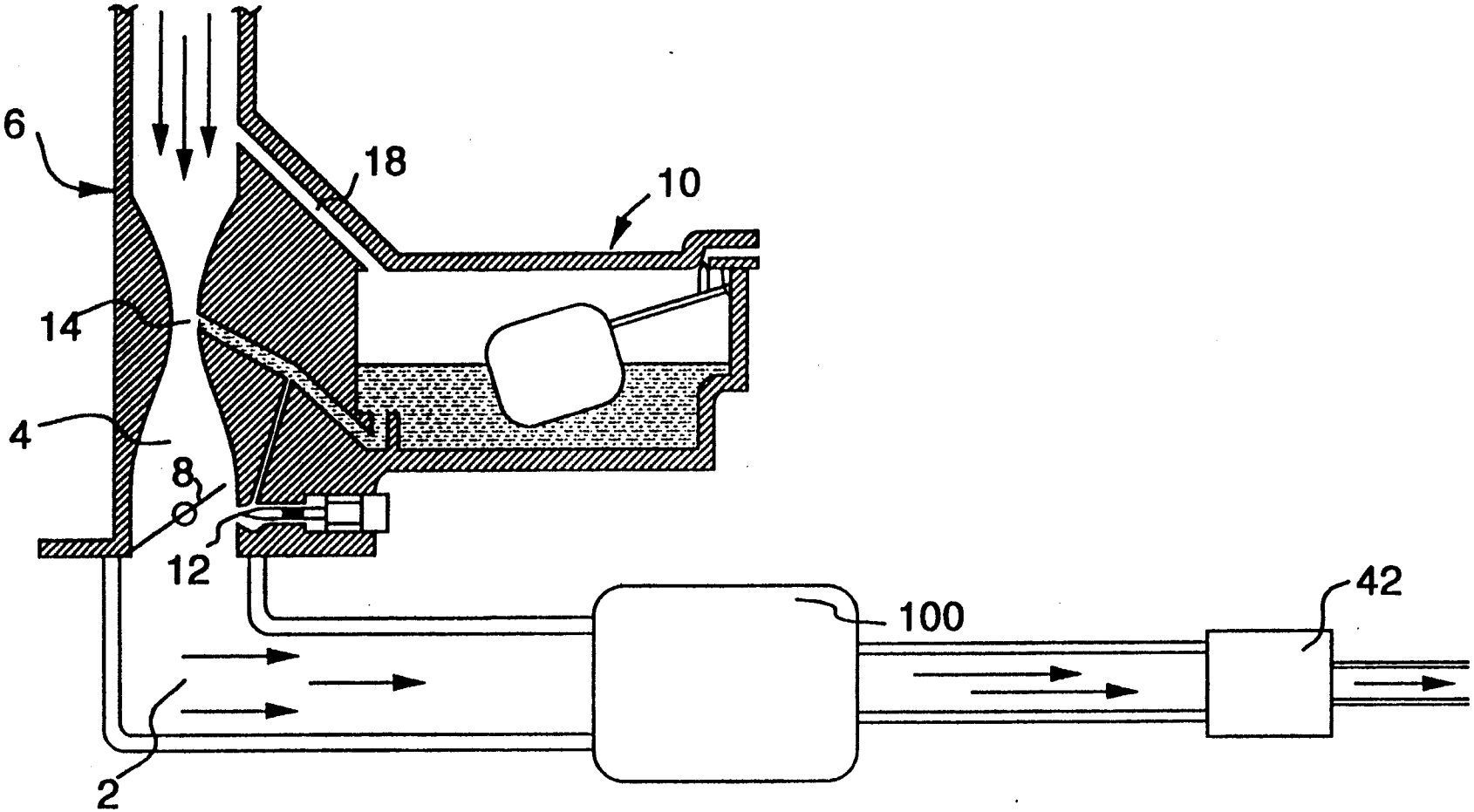
FIG. 1 is a schematic view of an internal-combustion engine fitted with a conventional carburetor.
Figure 2:
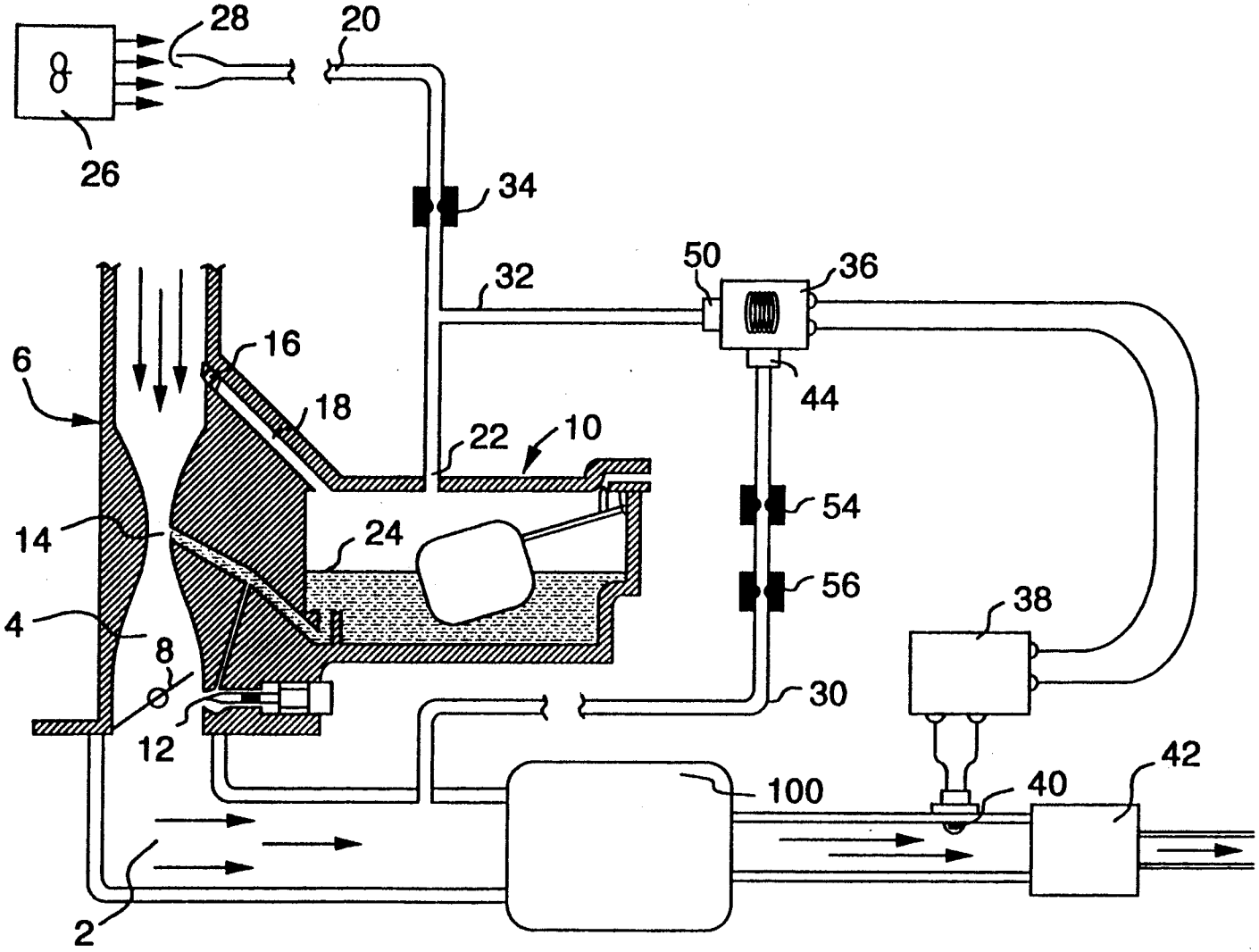
FIG. 2 is a schematic view of an internal-combustion engine carburetor retrofitted with a positive-pressure line and a negative-pressure line pneumatically connected to the engine's radiator fan and intake manifold, respectively, wherein the flow through each line is regulated by a control valve responsive to the oxygen content in the exhaust gases.

For purposes of explanation, the terms "positive" and "negative" are used herein to refer to pressures above and below the surrounding atmospheric pressure, respectively. Referring to the drawings, wherein like parts are designated throughout with like numerals and symbols, FIG. 2 illustrates in schematic representation the apparatus of the invention installed on an engine 100 fueled through a conventional carburetor 6. A positive pressure line 20 is tapped into the wall of the float chamber 10 at a point 22 above the fuel level 24, so that it is in pneumatic communication with the gaseous phase in the chamber. The line 20 is then extended to a point directly downstream of the engine's radiator fan 26 and the mouth of the end 28 of the line is positioned facing upstream, so that it constitutes a capture tube receiving the full flow of air generated by the fan. Also, the float chamber 10 is isolated from the outside atmosphere by introducing a plug 16 in the atmospheric vent 18 that is always found in conventional carburetors to provide a reference pressure for the operation of the venturi tube. Any means suitable to effect the permanent blockage of the vent 18 is acceptable for this purpose. We found that such a plug can be readily made with a material like a silicone compound, which is insoluble in gasoline and can be easily introduced into the vent 18 and allowed to harden.

Thus, the fuel in the float chamber becomes subjected to a positive pressure differential directly related to the speed of the fan 26 and the draft created thereby. Since the fan speed increases with the engine's speed, the positive pressure differential also increases and provides a higher pressure differential to the venturi tube, in turn resulting in more fuel being delivered to the air stream through the carburetor than would be the case if the float chamber were kept at constant atmospheric pressure. When compared to a standard carburetor having a float chamber vented to atmosphere, this feature tends to increase the incremental flow rate of fuel to the venturi as the engine's rmp increases, which is consistent with the need to balance the tendency of venturi tube operation to produce leaner mixtures at high speeds. Note that, by placing the mouth 28 of the capture tube in the positive pressure line downstream of the radiator fan, this feature is generally retained even for clutch-operated fans that are turned off by a radiator temperature control. That is so because these fans are usually turned off only at high vehicle speeds, when the wind and natural draft generated by the motion of the vehicle suffice to cool the radiator; therefore, the same draft is available to the positive pressure line 20 of the present invention. As the engine's rpm is reduced, the fan speed is correspondingly reduced and the positive pressure provided to the chamber becomes smaller. At the limit, when the fan stops, the line 20 connects the chamber to the outside atmosphere and it functions as a conventional atmospheric vent line. We found that using a positive pressure line having an inside diameter of approximately 9 mm and a capture tube having a mouth of about 16 mm produces pressure differentials in the order of 0 to 0.1 psi under normal operating conditions. A calibrated orifice 34 with an opening from approximately 1.4 mm to approximately 3.5 mm may be used in the line to adjust this pressure range to fit particular needs of different engines.

This invention functions by utilizing the contemporaneous effect of the above-described pressure source and of a vacuum source connected to it. Accordingly, a negative pressure line 30 (of size comparable to that of line 20) is tapped into the intake manifold 2 of the engine (anywhere downstream of the throttle valve 8) and is connected to the positive pressure line 20 by means of a fitting 32, such as a plain T coupling, near the tap 22 to the float chamber. Thus, the chamber is pneumatically connected also to a competing vacuum source and the pressure in the chamber is the net effect of the positive pressure produced by the fan 26 and the negative pressure produced by the intake manifold 2. Since the negative pressure produced at the intake manifold is normally in the order of 8 psi (as compared to the positive pressures of 0 to 0.1 psi generated by a radiator fan), it is apparent that the net effect of an uncontrolled system would be to always provide a strong negative pressure to the chamber, resulting in a much leaner fuel mixture than produced by a conventional carburetor. In fact, the strong vacuum would suck fuel out of the chamber and tend to stall the engine. Therefore, the net pressure differential produced in the float chamber is regulated by controlling the flow through the vacuum line 30 by means of a solenoid valve 36. When the valve 36 is closed, the positive pressure of line 20 is the only effect produced in the float chamber 10, resulting in a maximum positive pressure differential on the fuel. As the valve 36 opens and the positive pressure begins to bleed into the intake manifold through line 30, the pressure differential in the chamber 10 decreases until it becomes zero when the positive differential in line 20 equals the negative differential in line 30. Beyond that point the vacuum source prevails and begins to draw also from the float chamber's atmosphere, thus creating a negative pressure differential that increases with the further opening of valve 36. We found that a negative pressure differential of 0 to 0.1 psi can be produced in a controlled manner in the float chamber by means of this system. This range of negative pressure differential is found to be optimal to practice the invention with most commercial automotive engines.

In order to actuate the valve 36 in a feedback control mode, it is actuated by an electronic controller 38, which in turn is driven by an oxygen sensor 40 placed in the engine's exhaust manifold upstream of the catalytic converter 42 (if one if present in the system). As shown in other prior art apparatus, the oxygen sensor 40 produces a voltage directly related to the oxygen content in the exhaust. This oxygen content is a very accurate indicator of the degree of fuel combustion in the engine and, therefore, also of the deviations of the intake air-fuel mixture from its stoichiometric ratio. Accordingly, the voltage produced by the sensor 40 gives a quantitative measure of the deviations from the optimal air-fuel ratio under all operating conditions. Typically, the sensor 40 generates a voltage varying from 0 to 1 volts, and it is calibrated to produce 450 millivolts when the intake air-fuel mixture is stoichiometric (i.e., when maximum combustion occurs). The voltage produced by the oxygen sensor is converted by the electronic controller 38 into a corresponding actuating signal to the solenoid valve 36. When the voltage is less than 450 millivolts, indicating a lean mixture, the controller causes the valve to reduce the flow through line 30, thus increasing the net pressure differential in the float chamber and producing a mixture richer in fuel. The opposite happens, of course, when the voltage is greater than 450 millivolts.

Figure 3:
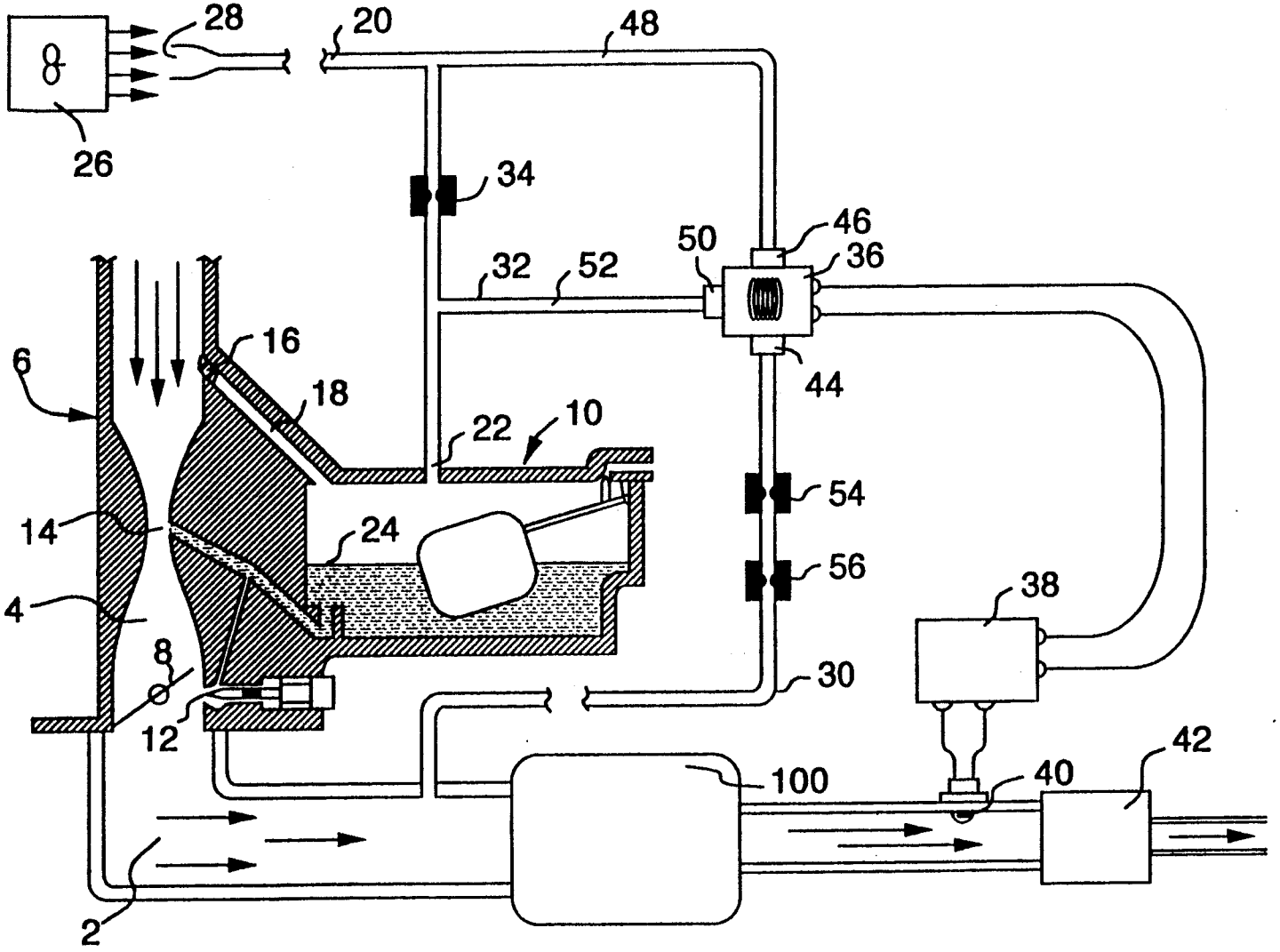
FIG. 3 is a schematic view of another embodiment of the invention containing an additional positive-pressure bypass line connected to a second input port of the control valve.

We found that the action of a cycling vacuum solenoid valve 36, such as the FCV valve sold by IMPCO Technologies, Inc. of Cerritos, Calif., instead of the linear action of a metering (proportional) valve is greatly preferred for implementing this invention because of the much faster response time it is able to provide. This type of valve can be operated either with a single input port (as illustrated in FIG. 2) or with two input ports 44 and 46, as shown in FIG. 3 and described below. In a single input-port configuration, the valve is normally closed and operates by cyclically opening the port at higher or lower frequencies depending on whether a higher or lower throughput is desired, respectively. Therefore, the flow through this valve is controlled simply by varying the frequency of the electrical input signal (pulse) to it, which either increases or decreases the rate of periodic opening of a dynamic flow-regulating component in the valve. No stepper-type motor is required to either open or close an otherwise static flow-regulating component in the valve, as in the case of proportional metering valves. Thus, the response time of a cycling solenoid valve is greatly reduced by eliminating the inertial effect of an intermediate mechanical driving device (motor) and of a static flow-regulating component. In addition, the electronic control logic required to drive a metering valve is more complicated, resulting in an overall significantly more expensive and less responsive system. We found that an electronic controller such as Part No. AFCP-1, also marketed by IMPCO Technologies, Inc., and the oxygen sensor sold by General Motors of Canada Limited, of Oshawa, Ontario, under Part No. 251 059 01 are excellent components for use in implementing the present invention in conjunction with the solenoid valve referenced above.

In operation, the controller 38 is calibrated to produce a maximum rate of cycling of the valve 36 when the oxygen sensor measures a low oxygen content corresponding to a rich fuel mixture (i.e., the voltage produced by the sensor is at its higher range), thus producing maximum vacuum in the fuel bowl and, correspondingly, a leaner mixture in the venturi tube. A minimum rate of cycling, which produces minimum throughput in the valve and maximum positive pressure in the float chamber, is conversely desired when the sensor measures a high oxygen content in the exhaust (corresponding to a lean fuel mixture).

In practice, a further refinement to the invention consists of using both input ports of the vacuum valve 36, as illustrated in FIG. 3. A positive-pressure bypass line 48 is used to connect the second input port 46 of the valve 36 to the main positive pressure line 20 (the recommended size of line 48 is approximately the same as that of lines 20 and 30). This additional flow rate from the positive-pressure line 20 is fed to the float chamber through the output port 50 when the second input port 46 is open and the first input port 44 is closed. Since the second port 46 is normally open while the first port is normally closed, the cycling effect of the two ports is opposite (the two ports operate on cycles that are 180 degrees out of phase). That is, a low frequency corresponds to a high positive-pressure line throughput and a low negative-pressure line throughput. As the cycle frequency of the valve is increased, not only is the vacuum line throughput increased but the positive-pressure line throughput is concurrently decreased, thus enhancing the response time of the system. Obviously, the direction of flow in the valve output line 52 depends on the net pressure drop within it as a result of the pressure at the connecting fitting 32 and the position of the flow-controlling components in ports 44 and 46. When this embodiment of the invention is used (which is preferred because of its greater versatility of operation) the calibrated orifice 34 is utilized to produce fine adjustments to the maximum positive pressure provided to the float chamber. Similarly, both embodiments shown in FIGS. 2 and 3 utilize calibration orifices 54 and 56 (at least one) ranging in size from about 0.35 mm to about 1.45 mm to regulate the maximum negative pressure transmitted upstream from the intake manifold 2. The exact sizing of these orifices permits the fine tuning of the system to the requirements of specific engines.

Figure 5:
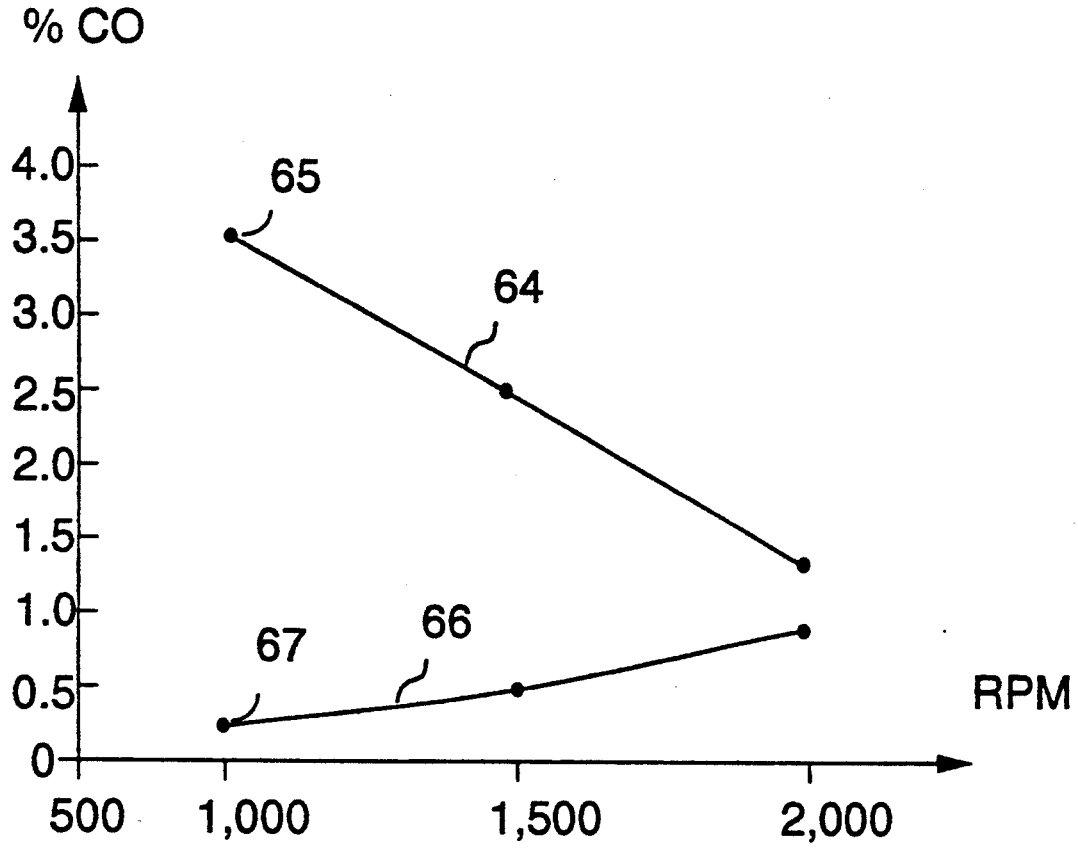
FIG. 5 is a graph illustrating the performance of the apparatus of the invention in reducing carbon monoxide emission.
Figure 4:
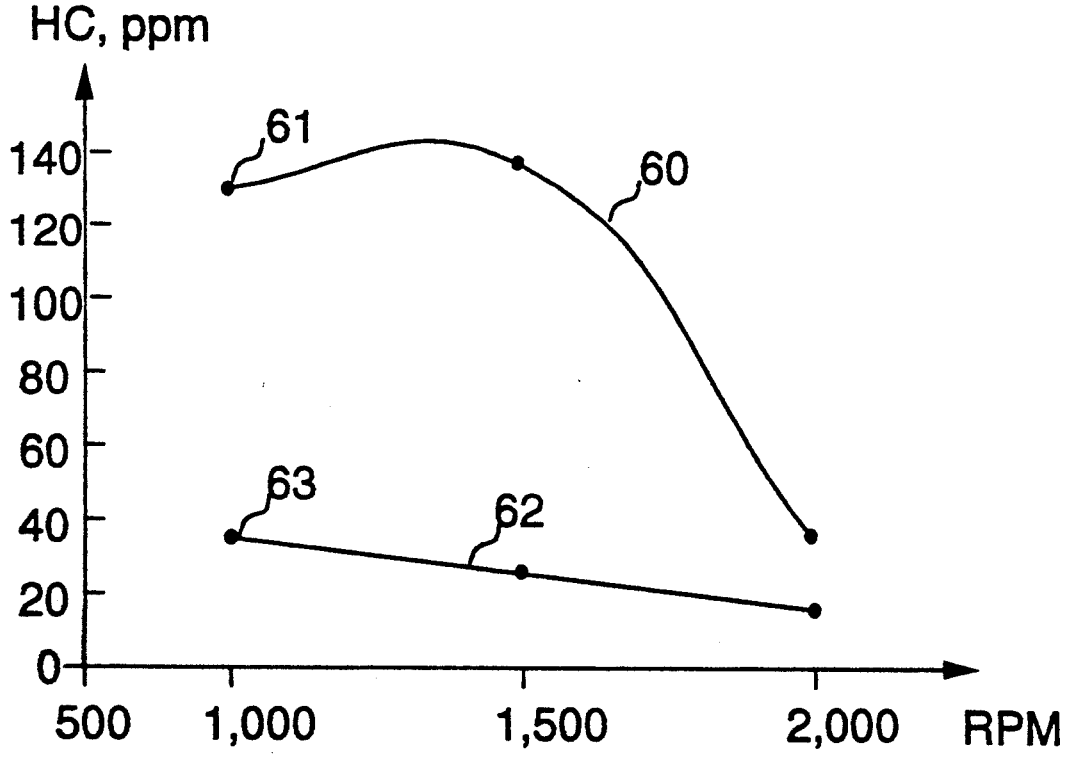
FIG. 4 is a graph illustrating the performance of the apparatus of the invention in reducing hydrocarbon emission.

FIGS. 4 and 5 illustrate the performance of the preferred embodiment of the invention as measured by the content of emission pollutants in the exhaust of a 1966 350-cubic-inch Chevrolet truck engine being operated with and without the float chamber pressure control. The apparatus of the invention was calibrated by using an opening of 2.5 mm for the orifice 34 and openings of 0.87 mm and 0.77 mm for theorifices 54 and 56, respectively. Carbon monoxide and hydrocarbons contents were measured with an Allen EPA Emissions 4-Gas Analyzer. Line 60 in FIG. 4 is based on data points 61 showing the hydrocarbon content at different engine speeds with standard carburetion equipment. Line 62 (based on data points 63) shows the corresponding reduced hydrocarbon content when the carburetor is modified according to the present invention. Lines 64 and 66 in FIG. 5 (based on sets of data points 65 and 67, respectively) illustrate comparable results for carbon monoxide content with and without the float control, respectively. Lines 62 and 66 represent measurements taken upstream of a catalytic converter. After conversion in the catalytic converter, the emissions showed no measurable remaining traces of carbon monoxide and a further significant reduction of hydrocarbons.

Note that this invention is designed primarily for use on older vehicles that do not have a catalytic converter in their exhaust system, which most countries in the world do not yet require. In order to improve the quality of emissions of these vehicles by means of retrofit apparatus, the addition of catalytic converters and switch to unleaded fuels constitute a proven and relatively inexpensive solution. The remaining problem is the fact that uncontrolled conventional carburetors tend to run too rich and greatly affect the performance and shorten the normal life of the catalytic converter. Moreover, catalytic conversion is directly related to the air-fuel ratio, being most efficient when the ratio is nearly stoichiometric (that is, about 14.7 to 1 fuel to air ratio by weight under normal conditions). Therefore, by also installing the apparatus of this invention, the performance and life of the converter are greatly improved. The life is lengthened to a duration comparable to that found in modern vehicles that contain factory-built feedback control.

In view of these results, it is apparent that this invention provides a relatively simple and inexpensive apparatus for improving significantly the performance of existing equipment. The installation of the invention requires few additional components and minimal modifications to standard equipment (a plug in the carburetor and taps in the carburetor and intake manifold). Therefore, it is particularly suitable for after-market application on carburetted older vehicles that are not equipped with a feedback emission control system.

While the embodiments of the carburetion system illustrated in the figures feature the specific components and physical structures therein described, the invention can obviously take other forms with equivalent functionality and utility. Various changes in the details, steps and materials that have been described may be made by those skilled in the art within the principles and scope of the invention herein illustrated and defined in the appended claims. Therefore, while the present invention has been shown and described herein in what is believed to be the most practical and preferred embodiments, it is recognized that departures can be made therefrom within the scope of the invention, which is therefore not to be limited to the details disclosed herein but is to be accorded the full scope of the claims so as to embrace any and all equivalent apparatus and methods.

We claim:

1. Apparatus for improving the emissions of internal-combustion engines having a radiator fan generating a first air stream and a carburetor wherein an air-fuel mixture is produced by drawing fuel from a fuel float chamber into a second air stream flowing through a venturi tube as a result of a vacuum provided at an intake manifold, comprising:

(a) first pneumatic passage means for connecting the float chamber of the carburetor and the first air stream, so that a positive pressure differential is available for application to the float chamber;

(b) second pneumatic passage means for connecting the float chamber and intake manifold, so that a negative pressure differential is available for application to the float chamber;

(c) valve means for controlling the flow rate through said second pneumatic passage means;

(d) sensor means for measuring the oxygen content of the exhaust gases of the engine and for generating a signal corresponding to said oxygen content; and (e) electronic control means for actuating said valve means in response to the signal generated by said sensor means, such that the flow rate through said valve means is progressively reduced as the oxygen content in the exhaust gases increases and is progressively increased as the oxygen content in the exhaust gas decreases.

2. The apparatus of claim 1, wherein said first and second pneumatic passage means are connected to form a single passage downstream of said valve means.

3. The apparatus of claim 2, wherein said first pneumatic passage means consists of a pressure line having a first open end facing the first air stream and a second end connected to the float chamber, and wherein said second pneumatic passage means consists of a vacuum line having a first end connected to the intake manifold and a second end connected to said pressure line.

4. The apparatus of claim 1, wherein said valve means consists of a normally-closed solenoid valve that is opened by cyclical pulses transmitted at variable frequency by said electronic control means.

5. The apparatus of claim 1, further comprising at least one calibration orifice in each of said first and second pneumatic passage means.

6. The apparatus of claim 3, wherein said valve means consists of a solenoid valve having a normally-closed first input port connected to said vacuum line and having a normally-open second input port; wherein the apparatus further comprises a bypass line having a first end tied into said pressure line upstream of said connection between the pressure and vacuum lines and having a second end coupled to said second input port of the solenoid valve; and wherein said first and second input ports are opened and closed, respectively, by cyclical pulses transmitted at variable frequency by said electronic control means, such that the flow rate through said first input port is progressively reduced as the oxygen content in the exhaust gases increases and is progressively increased as the oxygen content in the exhaust gases decreases and the flow rate through said second input port is progressively increased as the oxygen content in the exhaust gases increases and is progressively reduced as the oxygen content in the exhaust gases decreases.

7. The apparatus of claim 6, further comprising at least one calibration orifice in each of said pressure and vacuum lines.

8. A method of improving the emissions of internal-combustion engines having a radiator fan generating a first air stream and a carburetor wherein an air-fuel mixture is produced by drawing fuel from a fuel float chamber into a second air stream flowing through a venturi tube as a result of a vacuum provided at an intake manifold, comprising the following steps:

(a) connecting the float chamber of the carburetor and the first air stream through first pneumatic passage means, so that a positive pressure differential is available for application to the float chamber;

(b) connecting the float chamber and intake manifold through second pneumatic passage means, so that a negative pressure differential is available for application to the float chamber;

(c) providing valve means for controlling the flow rate through said second pneumatic passage means;

(d) providing sensor means for measuring the oxygen content of the exhaust gases of the engine and for generating a signal corresponding to said oxygen content; and (e) providing electronic control means for actuating said valve means in response to the signal generated by said sensor means, such that the flow rate through said valve means is progressively reduced as the oxygen content in the exhaust gases increases and is progressively increased as the oxygen content in the exhaust gases decreases.

9. The method of claim 8, wherein comprising the step of connecting said first and second pneumatic passage means to form a single passage downstream of said valve means.

10. The method of claim 9, wherein said step (a) is accomplished by providing a pressure line having two ends, by placing the first open end facing the first air stream and by connecting the second end to the float chamber; and wherein said step (b) is accomplished by providing a vacuum line having two ends, and by connecting the first end to the intake manifold and the second end to the pressure line.

11. The method of claim 8, wherein said step (c) is accomplished by providing a normally-closed solenoid valve that is opened by cyclical pulses transmitted at variable frequency by the electronic control means.

12. The method of claim 8, further comprising the step of installing at least one calibration orifice in each of said first and second pneumatic passage means.

13. The method of claim 10, further comprising the steps of providing a solenoid valve having a normally-closed first input port and a normally-open second input port, providing a bypass line having a first and a second end, tying the first end thereof into the pressure line upstream of the connection between the pressure and vacuum lines, coupling the second end to the second input port of the solenoid valve, and coupling the vacuum line to the first input port of the solenoid valve; wherein the first input port is normally closed and the second input port is normally open; and wherein the first and second input ports are opened and closed, respectively, by cyclical pulses transmitted at variable frequency by said electronic control means.

14. The method of claim 13, further comprising the step of providing at least one calibration orifice in each of said pressure and vacuum lines.

* * * * *